US005609334A

United States Patent [19]

Silveira et al.

[11] Patent Number: 5,609,334

[45] Date of Patent: Mar. 11, 1997

[54] APPARATUS AND METHOD FOR TRANSFERRING SHEETS OF PRINTED MEDIA

[75] Inventors: Frank S. Silveira, Wilmington; John B. Morse, Boston, both of Mass.

[73] Assignee: Polaroid Corporation, Cambridge, Mass.

[21] Appl. No.: 415,735

[22] Filed: Apr. 3, 1995

[51] Int. Cl.[6] ..... B65H 29/70

[52] U.S. Cl. ..... 271/188; 271/278; 193/2 A

[58] Field of Search ..... 271/209, 278, 271/306, 188, 314; 414/401; 198/860.1, 860.2; 193/2 A

[56] References Cited

U.S. PATENT DOCUMENTS

| | | | |
|---|---|---|---|
| 3,669,442 | 6/1972 | Thomas | 271/188 |
| 3,805,971 | 4/1974 | Behrens et al. | 214/6 BA |
| 3,815,457 | 11/1974 | Shimmin . | |
| 4,071,233 | 1/1978 | Morton, Jr. | 271/8 R |
| 4,353,274 | 12/1982 | Shimizu . | |
| 4,451,030 | 5/1984 | Teeter et al. . | |
| 4,734,743 | 3/1988 | Gregory, Sr. . | |
| 4,898,374 | 2/1990 | Vermaat | 271/178 |
| 5,116,036 | 5/1992 | LeRoy et al. | 271/3.1 |
| 5,241,353 | 8/1993 | Maeshima et al. | 355/321 |
| 5,246,224 | 9/1993 | Matsuno et al. | 271/242 |
| 5,284,337 | 2/1994 | Ettischer et al. | 271/220 |
| 5,288,064 | 2/1994 | Manabe et al. | 271/3.1 |
| 5,356,229 | 10/1994 | Hickman et al. | 271/188 |
| 5,414,503 | 5/1995 | Siegel et al. | 271/188 |

FOREIGN PATENT DOCUMENTS

| | | | |
|---|---|---|---|
| 2205049 | 5/1974 | France . | |
| 0004095 | 9/1979 | Germany . | |
| 3150459 | 9/1983 | Germany | 193/2 A |
| 2212481 | 7/1989 | United Kingdom | 271/209 |

OTHER PUBLICATIONS

PCT International Search Report.

*Primary Examiner*—H. Grant Skaggs
*Attorney, Agent, or Firm*—Leslie Payne

[57] ABSTRACT

Methods and apparatus are described for transferring laminated sheets from a printer to a separate processor therefor in a manner whereby the sheets are not crumpled, delaminated or otherwise damaged and whereby the printer and apparatus are easily aligned for facilitating such transfer. The apparatus includes an arrangement for inducing bending of the laminate and an arrangement for controlling the bending.

7 Claims, 5 Drawing Sheets

APPARATUS AND METHOD FOR TRANSFERRING SHEETS OF PRINTED MEDIA

CROSS-REFERENCE TO RELATED APPLICATION

This application is related to U.S. patent application, Ser. No. 08/261,159 filed Jun. 17, 1994, entitled METHOD AND APPARATUS FOR PEELING A LAMINATE and assigned to the Assignee of the present application. The disclosure of the aforementioned application, Ser. No. 08/261,159 is hereby incorporated by reference herein as a part hereof.

BACKGROUND OF THE INVENTION

The present invention relates generally to the transfer of discrete sheets. More particularly, this invention is directed toward providing improved methods and apparatus for transporting laminated media sheets of varying length from a printer to a separated processing apparatus as well as approaches for facilitating alignment of the printer and processing apparatus to enhance such sheet transfer.

In the graphics arts field, it is extremely important that so-called master images of the original objects being reproduced in a prepress operation be free of visually discernible image defects that would impact negatively in the formation of commercially acceptable prints. The master images are, in turn, used in the subsequent formation of either positive or negative copies, depending on the platemaking process employed. Since the final printed image will only be as good as its master image, considerable efforts are undertaken to produce only the highest quality master.

A recent development in the image forming arts has achieved high quality, high resolution images, such as radiological images of the medical type, without the need for silver halide film and processing techniques along with their attendant equipment and chemical processing issues. In this regard, high quality and high resolution images have been produced by a dry process imaging process which uses laser beams imaging on a thermographic image forming medium. Examples of this kind of thermographic image forming medium are described in commonly assigned International Patent Application No. PCT/US 87/03249 published Jun. 16, 1988, under International Publication Number WO 88/04237; and U.S. Pat. No. 5,200,297. After this laminate has been imaged, it is delaminated by peeling one layer therefrom and having the remaining imaged media relaminated with a protective coating. For a more detailed description of the imaging technique and an associated peeling process, reference is made to commonly assigned U.S. Pat. Nos.: 5,141,584 to Schuh et al and 5,159,352 to Ferla et at. The print engine or thermal laser imaging device for imaging laminates of the thermographic type operate to imagewise expose them by virtue of a laser printer. These thermographic prints are relatively flexible, yet are stiff and therefore present special considerations during handling thereof. For instance, these laminates are prone to peel or delaminate along their edges if handled incorrectly. Such undesired or premature delaminations might alter impermissably the desired image or otherwise affect their subsequent processing. Also, in the graphics prepress field, there is a requirement for printing sheets of varying dimensions so that transferring them from a printer to a separate processor can present problems.

It has been determined that in handling discrete sheets of media of different sizes, there is a possibility of undesirable crumpling or curling. Not only does the crumpling and curling affect adversely the subsequent sheet feeding in an orderly manner, but it may damage the particular sheets involved. This tendency for crumpling can be troublesome when handling thermographic laminates of the above type because the latter might delaminate prematurely along the edges, thereby impermissably altering the printed image. The situation is also aggravated because in certain situations longer sheets being transferred may curl and fold over in a manner such that their trailing edge is located adjacent their leading edge, thereby inhibiting proper feeding. Accordingly, there are continuing efforts to improve upon the transfer of the printed laminar media sheets, especially those having varying lengths in a manner for minimizing their crumpling, curling, damage, and misfeeding. Moreover, there is a desire to easily align the processor with the printer for facilitating the desired transfer of the printed laminates.

SUMMARY OF THE INVENTION

In accordance with the present invention, the objects of the invention include novel and improved methods and apparatus for transferring laminate media from a printer to a separate processing device which overcome the disadvantages and shortcomings noted, as well as enhances the transfer of media laminates from a printer to a separate processing device. Embodied in one illustrated embodiment, is an apparatus for transferring a laminate from a printer having an exit slot through which a driven laminate exits to an inlet opening in a separate processing device. The apparatus comprises, in combination: an in-feed means or assembly connected to the processing device; wherein the in-feed assembly includes a sheet feeding surface upon which the laminate sheet travels as it exits from the printer's exit slot and travels toward the inlet opening. Provision is made for means adjacent the feeding surface for engaging a leading edge of the advancing sheet for inducing a bending or curvature thereof in the direction of sheet advancement, whereby the bending diminishes the driving forces acting on the laminate's leading edge and thus, reducing any tendency for the leading edge to delaminate if it strikes any resistance. Provision is also made for means spaced from the feeding surface and the bending means such that as laminates of different lengths travel thereon, this means controls the amount of lengthwise laminate bending induced by the bending means so that a laminate's trailing edge does not undesirably curl, whereby a trailing edge of the laminate might fold over onto a leading edge of the laminate adjacent the inlet opening.

In an illustrated embodiment, the bending means includes a curved surface in the path of travel of the laminate. In another illustrated embodiment, the bending means includes a protrusion on the feeding surface having a ramp for inducing such bending of the laminate.

In another illustrated embodiment, the bending control means is provided with a pair of spaced apart guide rods which extend generally transversely relative to the inlet opening and which are spaced apart on opposite sides of the bending means, such that one guide is adjacent the inlet opening and a leading edge of the laminate, while the other guide is adjacent a trailing edge of a long length laminate. In this manner, the trailing edge will not fold or curl over adjacent the leading edge, thereby reducing the possibility of misfeeding the sheet through the inlet opening.

In another illustrated embodiment there is provided a method of visually aligning an in-feed assembly of a processor to a printer. The method comprises the steps of: providing an arm extending from the processor and being provided with at least a notch adjacent the arm's distal end, wherein the notch is bordered by generally vertical and horizontal aligning edges which edges create imaginary lines which intersect, preferably, orthogonally. Provision is made for providing the printer with a pair of aligning edges which are alignable with the corresponding horizontal and vertical edges on the printer. The method includes placing a corner of the printer adjacent the notch, whereby the aligning edges on the arm are visually aligned with the corresponding aligning edges of the printer for assisting in visually aligning the processor in x and y axes relative to the printer.

Other objects and further scope of applicability of the present invention will become apparent when reading the following detailed description thereof when taken in conjunction with the accompanying drawings wherein like parts are represented by like reference numerals throughout the several views.

BRIEF DESCRIPTION OF THE DRAWINGS

FIG. 1 is a perspective view of a printer and peeler/laminator arrangement in which the improved laminate transfer apparatus is to assist in transferring printed laminates between;

DETAILED DESCRIPTION

Figure 1:
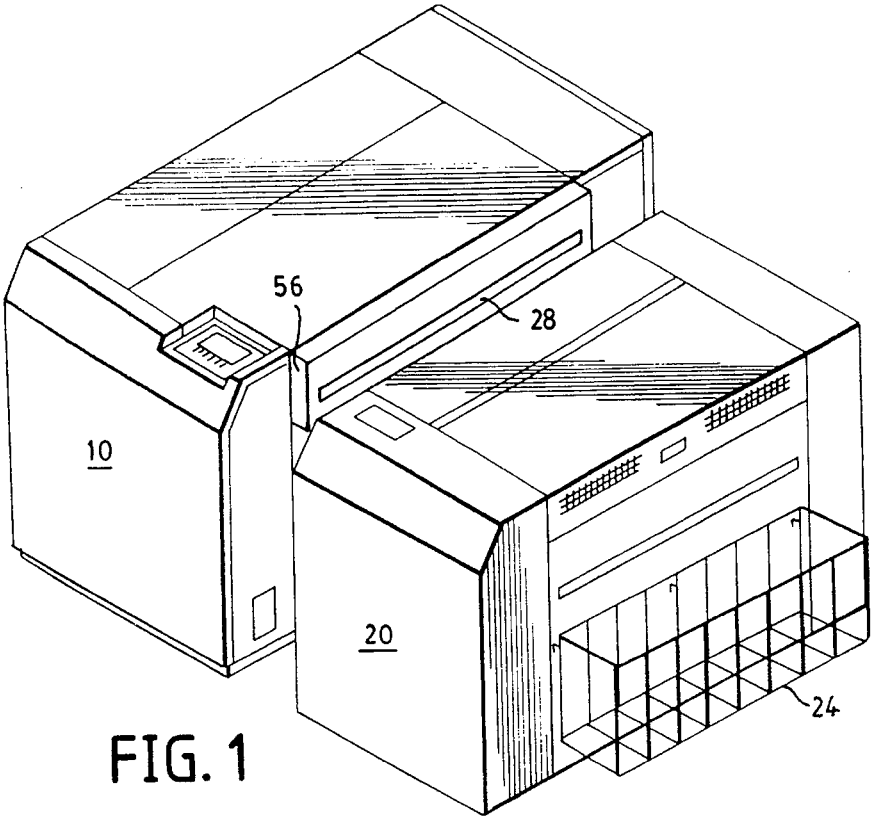
Figure 2:
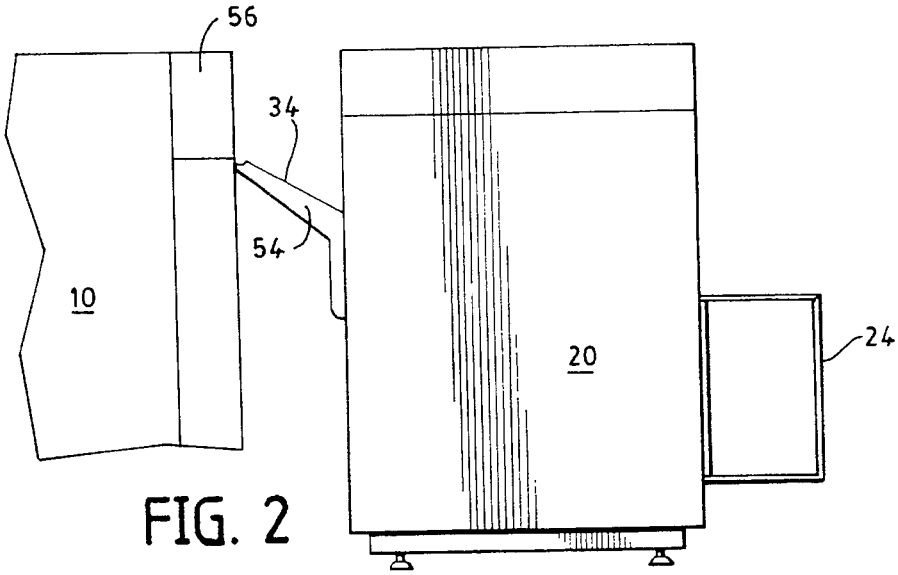
FIG. 2 is an end view of the peeler/laminator as shown in FIG. 1 with certain portions thereof omitted for clarity.
Figure 1A:
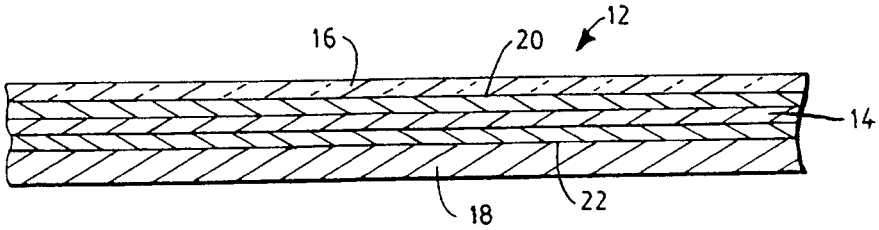
FIG. 1*a* is a longitudinal cross-sectional view of one type of laminate with which the present invention is concerned.
Figure 3:
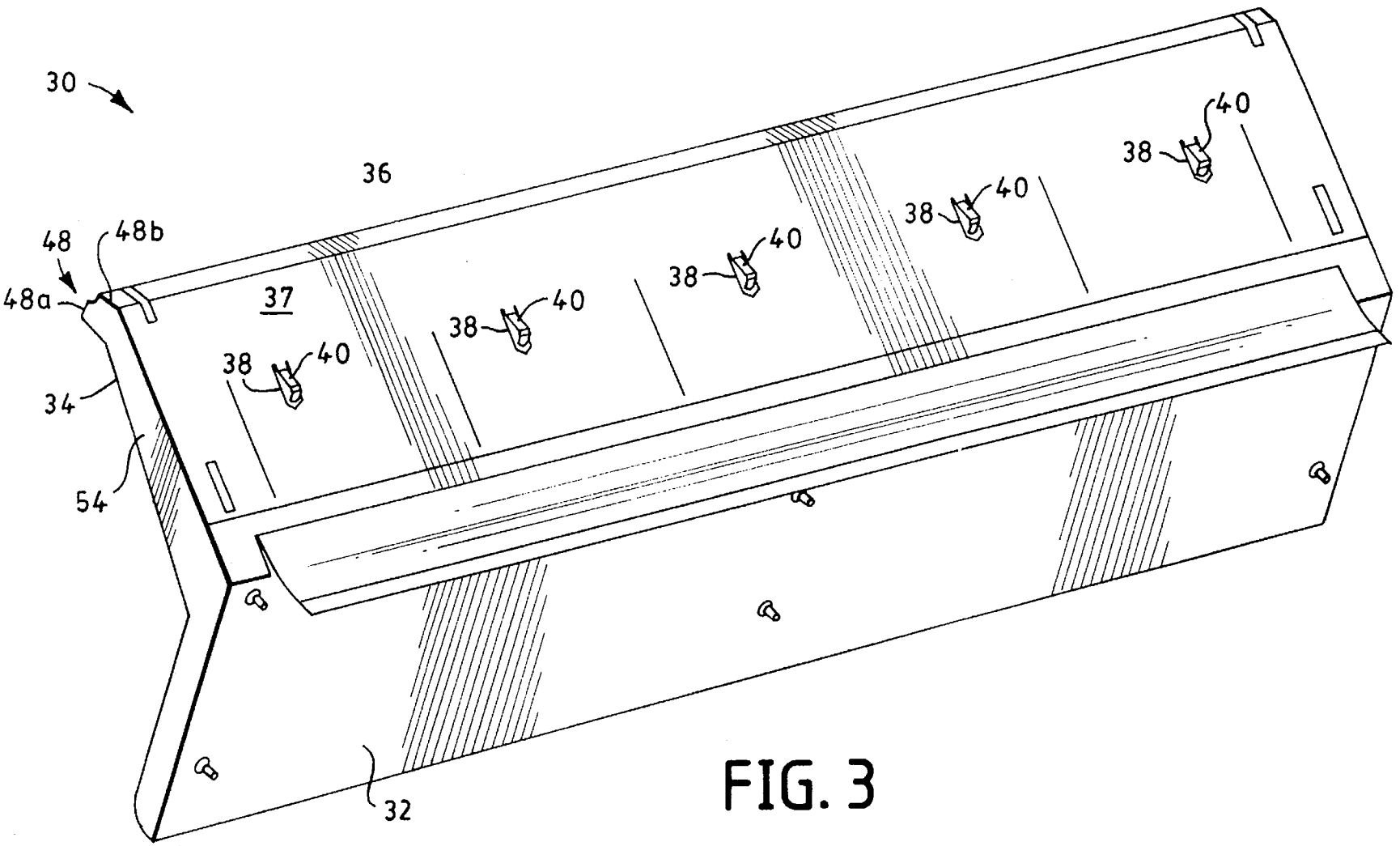
FIG. 3 is a perspective view of an in-feed assembly with certain portions thereof omitted for showing certain aspects of its construction.
Figure 4:
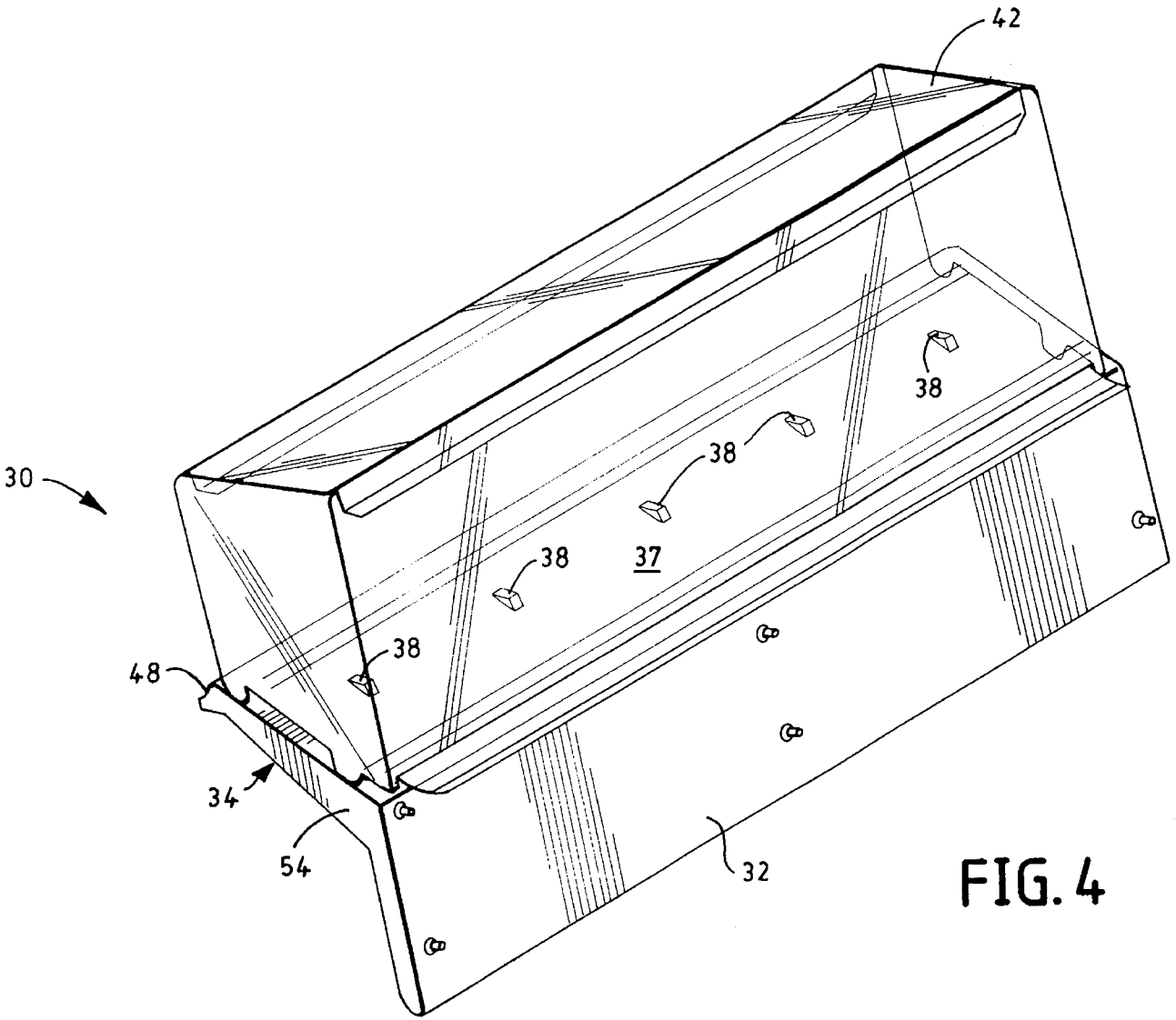
FIG. 4 is a perspective view of an in-feed assembly similar to FIG. 2, but with a housing added.

Reference is initially made to FIGS. 1–6 for illustrating one preferred embodiment of the present invention. As depicted in FIG. 1, there is provided a print engine or thermal laser imaging device 10 for producing laminates of the type shown, for instance at 12 in FIG. 1*a*. These laminates 12 include image media that has been produced in the print engine 10 through thermal imaging, such as by a laser or any other suitable device. In this embodiment, the laminate includes an internal layer 14 comprised of an image forming layer, such as carbon, and opposite image-bearing layers 16 and 18 on opposite sides of the image-forming layer as well as adhesive layers respectively bonding the image-bearing layers to the pigment or image-forming layer. For a more detailed description of the laminates with which the present invention is concerned, reference may be had to International Patent Application No. PCT/US87/03249 published Jun. 16, 1988 under International Publication No. WO/04237 and U.S. Pat. No. 5,200,297. It will be appreciated that the advantages of the present invention are not particularly directed to the construction of the laminate itself and therefore such laminate does not form pan of the present invention. After the laminate has been imparted with an image by the print engine 10, it is deposited by the latter at an inlet of a peeler/laminator unit 20. The peeler/laminator unit 20 does not, per se, form a part of the present invention. Therefore, only those portions of the peeler/laminator unit 20 which are necessary for understanding the present invention will be set forth. Basically, the peeler/laminator unit 20 includes a transversely extending inlet opening 22 (FIG. 5) through which successive sheets of the laminate 12 are fed for subsequent peeling and laminating as described in copending and commonly assigned U.S. patent application Ser. No. 08/261,159. The inlet opening 22 is dimensioned to accept various widths of the laminates which are printed in the print engine 10. After the laminate 12 is processed by the peeler/laminator unit 20, it is deposited in an outlet basket 24.

Figure 5:
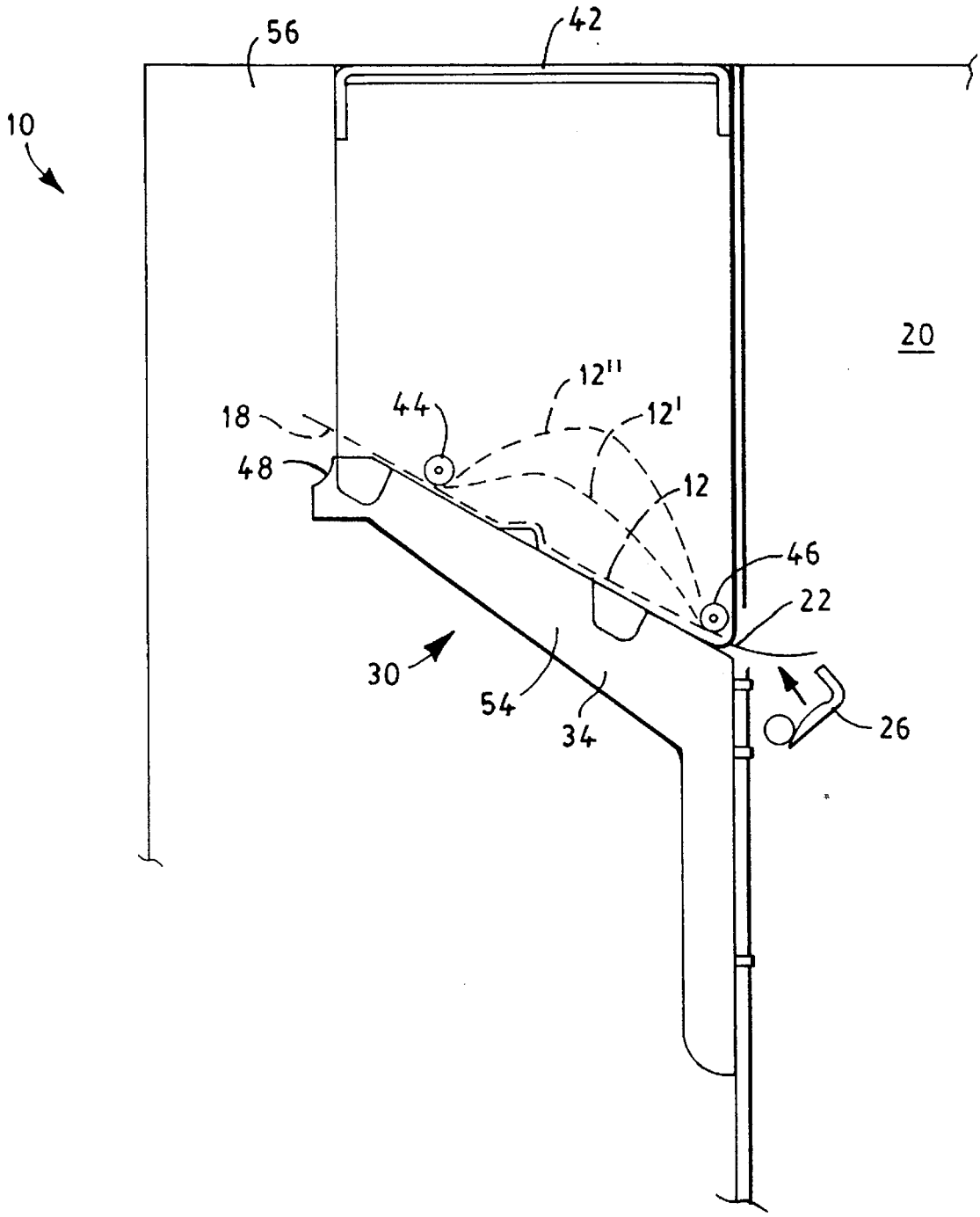
FIG. 5 is a side view of the in-feed assembly shown in FIG. 4.
Figure 6:
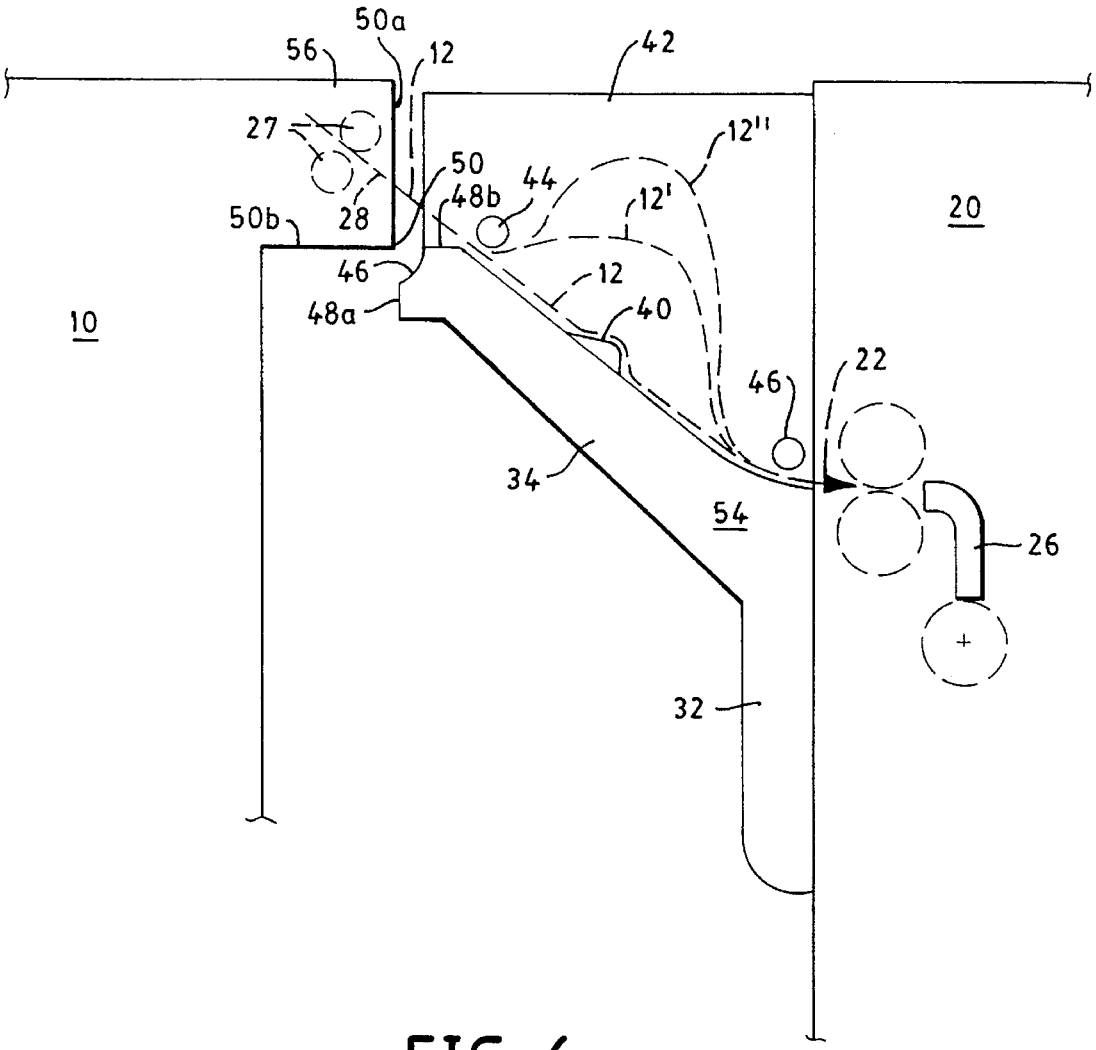
FIG. 6 is a diagrammatic side view of the printer and peeler/laminator unit better illustrating an improved aligning approach of the present invention.

With continued reference to FIGS. 5 and 6, the peeler/laminator unit 20 includes a plurality of spaced apart gate fingers 26, only one of which is depicted. The gate fingers 26 are transversely oriented along and adjacent the longitudinal extent of the inlet opening 22. The gate fingers 26 are operable in a raised mode for blocking the leading edge of the laminated sheets 12 from entering the peeler/laminator unit, and in another lowered mode for allowing passage of successive sheets into the peeler/laminator unit. When the fingers are in their blocking mode there is a possibility of the sheets delaminating at their edges when striking them. When the fingers are moved to a lowered or operative position, the sheets may be transferred to a pair of entrance rollers (not shown). It will be appreciated that in the normal course of operation, the laminated sheets from the print engine are fed to the peeler/laminator unit, such that a leading edge of the laminate engages the gate fingers. In this regard, inside the print engine 10 is located a laminate drive system (not shown) which can include a pair of exit feed rolls that are operable for positively feeding successive sheets of the printed laminates through an elongated exit slot 28. In practice, there may be considerable forces imparted to the printed laminated sheet 12 by the drive system of the printer 10, such that when the leading edge of the sheet engages the gate fingers, undesirable sheet edge delamination may result.

Attached to one side of the peeler/laminator unit 20 is an inclined in-feed assembly 30 which is sized and configured to extend between the exit slot 28 of the printer and the inlet opening 22. The in-feed chute assembly 30 includes a mounting bracket 32 which is attached to the peeler/laminator unit 20, and a pair of laterally or transversely spaced apart arms 34 projecting upwardly from the bracket and having a generally planar chute panel 36 extending to and therebetween. The panel 36 defines a smooth feeding surface 37 for facilitating sliding of the laminate 12 thereon. The panel 36 is, preferably made of sheet metal, and includes a plurality of integral and upstanding knuckle-like protrusions or projections 38 formed so as to be spaced apart with respect to each other and along the transverse extent thereof. Each of the projections 38 has an inclined ramp 40 and the ramps are positioned to engage a leading edge of the laminate being fed from the printer 10. A trailing edge of each projection 38 depends toward the surface 37. In practice, a leading edge of the laminate engages the projections 38 and will ride up the ramps and over the projections as it travels to and ultimately engages the gate fingers 26. These projections 38 cause the beam of the exiting and driven laminate 12 to lengthwise bend or cud and assume an arcuate shape, such as like that depicted by the phantom lines in FIGS. 5 and 6. In particular, the bending action serves to break the beam of the exiting laminate 12 and thereby diminish the driving force of the laminate's leading edge against any resistance, such as the fingers. Accordingly, the likelihood of laminate edge delaminations and potential damage to the image and/or hindrance of subsequent sheet processing are reduced significantly. Although, a plurality of protrusions are used, clearly a single surface can extend between the arms 34.

A housing member 42 is positioned over the chute panel 36 and rests on the arms 34. The housing member 42 is made, preferably, of a transparent plastic material and is easily removable from the in-feed assembly panel for facilitating removal of laminate sheets therein, and for detecting any jamming which might otherwise occur. In addition, the housing tends to prevent dust and debris from contacting the film as the latter is transferred. A pair of guide rods 44, 46 extend to and between housing sidewalls and thus are generally transverse to the inlet opening 22. The guide rods 44, 46 each have an elastomeric exterior so as to facilitate the transfer of laminates without damaging the surfaces of the latter. The guide rods 44, 46 are spaced apart by a distance which is selected to be approximately equal to the shortest length of laminate which is to be transferred from the printer to the peeler/laminator unit. The guiding rods 44 are closely spaced from an upper surface of the panel 36 and act to control the degree to which the laminate curls after it strikes the gate fingers 26. In this regard, curling or bending is controlled so that a trailing laminate sheet edge does not fold over to the extent that the trailing edge is positioned immediately adjacent a leading edge, whereby both can be feed simultaneously into the peeler/laminator unit 20. The guide rods 44, 46 are spaced apart so that the guide 46 is adjacent the inlet opening 22 and a leading edge of the laminate as illustrated, and the other rod 44 is spaced close to the distal end of the feeding surface 37 and a trailing edge of the laminate. As a result, a curled laminate regardless of length will not have its trailing edge fold or curl over a leading edge and thereby possibly result in misfeeding of both edges simultaneously to the inlet opening. In addition, there is less of a tendency to have the laminates crumple when being fed. These advantages enhance the versatility of handling sheets especially of the thermographic type.

Reference is made to FIG. 6, for illustrating an embodiment of the invention which facilitates an alignment of the in-feed chute assembly and the printer. In practice, it is desirable to have the printer 10 and the peeler/laminator unit 20 separated since there is a desire to isolate vibrations of the former from the latter. In addition, it is desirable to move the peeler/laminator unit 20 to better facilitate use by an operator. But there is required fairly accurate alignment between the printer and the peeler/laminator for purposes of transferring the sheets. In this embodiment, each of the arms 34 has a generally rounded notch or cut-out 48 which is bordered with a vertical aligning edge 48*a* and a horizontal aligning edge 48*b*. Visual extensions or imaginary lines of the vertical and horizontal aligning edges 48*a* and 48*b* are created and will intersect with each other, preferably, orthogonally. The aligning edges 48*a* and 48*b* are adapted to align with corresponding edges 50*a* and 50*b* on the printer 10. The notch 48 can have several other configurations besides that illustrated which are usable consistent with the principles of the present invention. Because of the notch 48 and the aligning edges 48*a*, 48*b*, an operator can place the corner 50 of the printer 10 immediately adjacent the notch 48 and have the edges 50*a*, 50*b* aligned with the edges 48*a*, 48*b* by taking advantage of a virtual centerpoint created by an imaginary radius line of the notch 48 intersecting the apex of the imaginary lines of edges 48*a*, 48*b*. In addition, the notch provides a clearance for the edges of the printer relative to the peeler/laminator. Accordingly, a relatively simple and straight forward approach is used for aligning the printer and the in-feed chute in the x and y axes without the need for actually measuring the required distances between the printer and the in-feed chute. In addition, the in-feed chute assembly is aligned along a z-axis. This is accomplished by having an outside surface 54 of one of the arms 34 alignable and coplanar with a corresponding surface 56 formed on the printer 10; such as illustrated.

Although several specific and preferred methods and apparatus of the present invention have been shown and described above, other variations of the present invention will become apparent to those skilled in the art. The scope of the invention is therefore not limited to the specific forms shown and described, but rather is indicated by the claims below.

What is claimed is:

1. Apparatus for transferring a laminate from a printer having an exit slot through which a driven laminate exits to a separate processing device having an inlet opening for the laminate, comprising in combination: in-feed means connected to the processing device; said in-feed means including a feeding surface upon which the laminate slides as it exits from the exit slot of the printer toward the inlet opening; means on said surface for engaging a leading edge of the laminate as the laminate advances toward the inlet opening for inducing a bending of the laminate which diminishes the driving forces on the laminate; and, means spaced from said feeding surface and the laminate traveling thereon for controlling the amount of laminate bending induced by said bending means so that a trailing edge of the laminate is inhibited from curling over a leading edge of the laminate adjacent the inlet opening; said control means includes a pair of spaced apart guide rods which extend generally transversely relative to the inlet opening and which are spaced apart such that one of said rods is adjacent the inlet opening and a leading edge of the laminate and the other of said rods is adjacent a trailing edge of the laminate, such that a trailing edge of a curved laminate will be inhibited from folding or curling over so as to be adjacent a leading edge of the laminate at the inlet opening.

2. The apparatus defined in claim 1 wherein said bending means includes at least a protrusion on said feeding surface which has a ramp that acts to induce the bending of the laminate.

3. The apparatus defined in claim 2 wherein said protrusion is formed integrally with said feeding surface and includes a ramp surface thereon for engaging the leading edge of laminate.

4. The apparatus defined in claim 1 wherein there is provided a plurality of said protrusions spaced apart relative to each other along a transverse extent of said feeding surface which is generally parallel to the inlet opening.

5. The apparatus defined in claim 4 wherein there is further provided a housing enclosing said in-feed means, said housing protecting against dust and debris and being made of a transparent material; said guide rods being connected to and between opposed sidewalls of the opening.

6. A method of visually aligning an in-feed chute assembly of a processor wherein the in-feed assembly includes at least one arm extending from the processor to a printer, comprising the steps of: providing the arm with at least a notch adjacent its distal end, wherein the notch is bordered by generally vertical and horizontal aligning edges wherein imaginary lines of the edges intersect; providing the processor with a pair of aligning edges which are alignable with the corresponding horizontal and vertical edges on the printer; and, placing a corner of the printer immediately adjacent the notch whereby the aligning edges of the arm are alignable with the corresponding edges of the printer for assisting in visually aligning the printer and the in-feed chute assembly along respective x and y axes; further comprising the step of providing the arm with a planar surface which is alignable with the printer so as to align the in-feed chute assembly to the printer along a z-axis.

7. The method of claim 6 wherein the notch is rounded and has an imaginary radius intersect with an apex of the imaginary lines of the aligning edges of the arm to create a virtual centerpoint of the edges on the printer with the aligned edges on the processor.

* * * * *